US005378048A

United States Patent [19]

Parrott

[11] Patent Number: 5,378,048

[45] Date of Patent: Jan. 3, 1995

[54] SPRAY NOZZLE FOR MINING

[75] Inventor: George A. Parrott, Barnsley, England

[73] Assignee: Minnovation Limited, Barnsley, England

[21] Appl. No.: 121,345

[22] Filed: Sep. 14, 1993

[30] Foreign Application Priority Data

Sep. 29, 1992 [GB] United Kingdom ..... 9220537

[51] Int. Cl.[6] ..... B05B 15/06; E21C 35/22

[52] U.S. Cl. ..... 299/81; 175/424; 239/600; 239/DIG. 8

[58] Field of Search ..... 175/424, 393; 299/81, 299/92, 12, 17; 239/600, DIG. 8

[56] References Cited

U.S. PATENT DOCUMENTS

| | | | |
|---|---|---|---|
| 5,007,684 | 4/1991 | Parrott | 299/81 |
| 5,195,805 | 3/1993 | Claphan | 299/81 |
| 5,234,258 | 8/1993 | Komotzki | 175/424 X |

FOREIGN PATENT DOCUMENTS

| | | |
|---|---|---|
| 2239822A | 7/1991 | United Kingdom . |
| 2246588A | 2/1992 | United Kingdom . |

*Primary Examiner*—Stephen J. Novosad
*Attorney, Agent, or Firm*—Trexler, Bushnell, Giangiorgi & Blackstone, Ltd.

[57] ABSTRACT

A water spray nozzle (1) for location in a receiving bore (2) of a pick box (3) of a rotary cutting head (4) of a mining machine, comprising an elongate and generally cylindrical body member (5) having at one end an entry nose (6) and at the other end an enlarged extraction head (7), in use, intended to remain outside the receiving bore (2). A radial, water inlet orifice (8) intermediate the ends of the body member (5) leading to a water receiving chamber (25). A water sealing ring (9) located in a retaining groove (10) in the body member (5) between the water inlet orifice (8) and the nose (6) . A water discharge orifice (11) is in communication with the chamber (25). A reduced diameter formation (12) on the body member (5) has a resilient, nozzle-retaining ring (13) of material and/or dimensions such that it is compressible and/or deformable, into a nozzle retaining mode, without additional retaining means. The invention also includes a combination of nozzle (1) and pick box (3) , and also a mineral cutting head (4) provided with such pick boxes.

14 Claims, 9 Drawing Sheets

SPRAY NOZZLE FOR MINING

This invention relates to a spray nozzle for location in a receiving bore of a pick box of a rotary cutting head of a mining machine. The latter may be a so-called roadheader machine for driving tunnels or underground roadways, or a so-called shearer for the winning of minerals, particularly coal. The invention also includes a pick box provided with such a nozzle, and a rotary cutting head provided with an array of such pick boxes.

Whilst spray nozzles using a screw fit into a receiving bore of a pick box, have been widely used in the mining industry, attempts have been made in recent times to provide screwless nozzles which avoids the recognised drawbacks of screw-fit in extracting, cleaning and re-fitting a nozzle in a mine environment; rusting due to the wet conditions; the propensity for nozzle blockage due to mine debris or even debris in the water supply; and the delays in starting a machine due to in-built safety systems if an insufficient number of nozzles are operating satisfactorily. A second but not insignificant consideration is the need to so locate a nozzle that is not prone to damage yet emits an effective spray, which has led to so-called "rear entry" spray nozzles e.g., GB 2239822.

A basic object of the present invention is to provide an improved water spray nozzle over prior proposals.

According to a first aspect of the present invention there is provided a water spray nozzle for location in a receiving bore of a pick box of a rotary cutting head of a mining machine, comprising an elongate and generally cylindrical body member having at one end an entry nose and at the other end an enlarged extraction head, in use, intended to remain outside the receiving bore; a radial, water inlet orifice intermediate the ends of the body member leading to a water receiving chamber, a water sealing ring located in a retaining groove in the body member between the water inlet orifice and the nose, a water discharge orifice in communication with the chamber, a reduced diameter formation on the body member with a resilient, nozzle-retaining ring on the reduced diameter formation , the retaining ring being of material and/or dimensions such that it is compressible and/or deformable, into a nozzle retaining mode, while to extract the nozzle, sufficient extraction force must be applied to re-deform and/or re-compress the retaining ring to permit extraction of the nozzle from its receiving bore by an extraction force applied to the enlarged head.

Thus, the nozzle in accordance with the invention provides for a screwless "push-in" fit, with nozzle retention effected solely, or virtually solely, by the retaining ring, and extraction, against the retaining and restraining action of the retaining ring, crown, by engaging the enlarged head with a simple tool such as a screwdriver blade yet providing satisfactory resistance to unintentional extraction e.g. if subjected to water pressure, machine vibration etc.

In practice, the nozzle needs to be slightly longer than the bore, so that to engage the enlarged head to remain clear of the bore, so as to be engageable by a extraction tool. It is also preferred for the nozzle to be hydraulically balanced when subjected to the water pressure e.g., 600 p.s.i., and hence there is no hydraulic force urging the nozzle from the bore of the pick box which the retaining ring needs to resist.

Although a single water seal could be provided, relying on the retaining ring to function also as a water seal, preferably a second water seal is provided located in a second retaining groove is intermediate the water inlet orifice and the enlarged head.

In detail, the nozzle may be provided with a reduced diameter portion over which a removable gauze filter sleeve is fitted.

Preferably, the nozzle is separable e.g., by being formed from two parts screwed together, so that the two parts may be unscrewed to enable the gauze sleeve to be removed and cleaned and, if necessary, the discharge orifice to be unblocked.

In a first embodiment, the reduced diameter formation on which the retaining ring is mounted may have a first frusto-conical surface directed toward the nose, a second frusto-concial surface directed towards the head, and an annular, maximum diameter crown common to, and separating, the two frusto-conical surfaces, with the restraining ring, in the nozzle-inserted condition being on the frusto-conical surface that is directed towards the enlarged head, whilst during extraction of the nozzle, the restraining ring is rolled up this surface over the crown and onto and down the frusto-conical surface directed towards the nose and so positioning the ring correctly for re-entry. An example is shown on sheets 1 to 3 of the accompanying drawings.

The frusto-conical surfaces may be machined onto a metallic body of the nozzle.

In accordance with another aspect of the invention, the nozzle-retaining ring is of tear-shaped or pear-shaped profile which is displaceable between a low resistance, nozzle insertion position, and a high resistance, nozzle extraction position. An example is shown on sheet 4 of the accompanying drawings.

In accordance with another aspect of the invention of independent significance, the retaining ring is constituted by a resilient disc or grab ring located on the reduced diameter formation of the nozzle with clearance, with the disc displaceable between a low resistance, nozzle insertion position, and a high resistance nozzle extraction position. An example is shown on sheets 5 and 6 of the accompanying drawings.

This aspect provides a captivated disc washer or grab ring that will latch or engage the nozzle receiving bore of the pick box to resist retraction, and as such a disc washer or grab ring would normally be metallic, e.g. a belville type washer, a second water sealing ring would be required. The disc washer or grab ring is also preferably frusto-conical with its apex directed towards the nose of the nozzle, to provide the differing insertion and extraction forces.

In accordance with another aspect of the invention, there is provided, in combination, a pick box having a nozzle receiving bore, in which is located a nozzle as defined above. With the nozzle and box combination, whilst it could be arranged for the retaining ring to engage a plain surface of the receiving bore, preferably the surface is interrupted e.g., by at least one circumferential groove. It is however preferred for the interruption to be provided by tapping a thread into the nozzle receiving bore of the pick box, over a short length, adjacent its rear end. Also, the receipting bore preferably terminates in a frusto-conical seat, engageably by a frusto-conical terminal nose of the nozzle.

In accordance with another aspect, there is provided a rotary cutting head of a mining machine provided with an array of pick boxes as defined above.

Whilst normally, the water discharge orifice would be at the nose, there may in certain circumstances be a requirement for discharge at the enlarged head end, if for example the nozzle was intended for front entry into a bore of a pick box, so that for instance the nozzle may be extracted without the need to first extract the associated pick. Examples are shown on sheets 7 to 9 of the accompanying drawings.

The various aspects of the invention will now be described in greater detail, by way of examples, with reference to the accompanying drawings, in which.

In all embodiments, like reference numerals are employed for like components.

Figure 12:
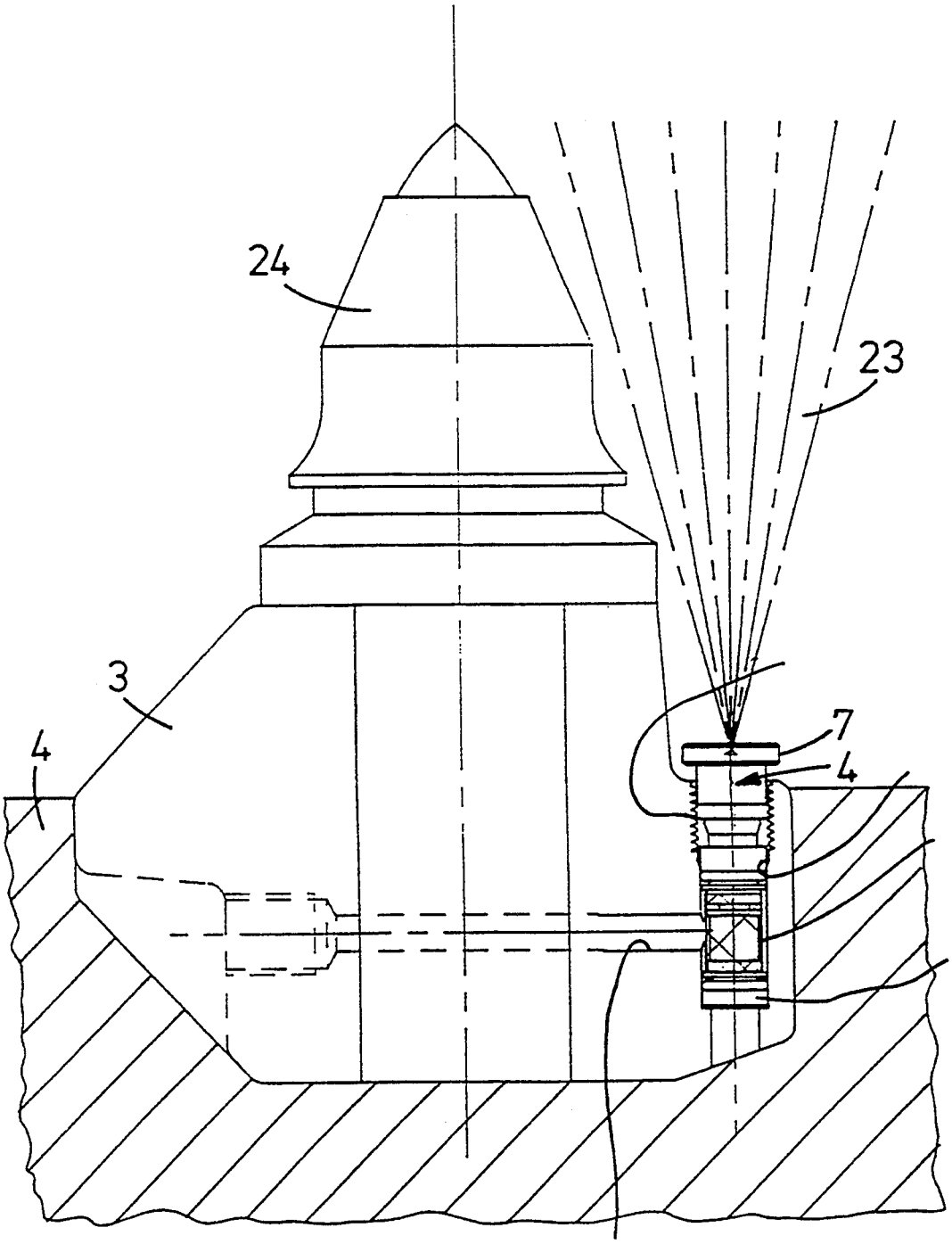
FIG. 12 shows a fourth embodiment of nozzle to a smaller scale;.

A water spray nozzle 1 is adapted to be received in a bore 2 of a pick box 3 welded to a rotary, mineral cutting head 4 (FIG. 12). The nozzle 1 comprises an elongate and general cylindrical body member 5 having at one end an entry nose 6 and at the other end an enlarged extraction head 7. A radially extending, water inlet orifice 8 is provided intermediate the ends of the body member 5, while a water sealing ring 9 is located in a retaining groove 10 in the body member 5 between the water inlet orifice 8 and the nose 6. A water discharge orifice 11 is provided in the nose 6 in the embodiments of FIGS. 1 to 11, and in the head 7 in the embodiments of FIGS. 12 to 14. A reduced diameter formation 12 is provided in the body member 5 on which a resilient, nozzle-retaining ring 13 is located, the ring 13 being of material and/or dimensions such that it is compressible and/or deformable into a nozzle retaining mode, and is re-deformable and re-compressible to achieve nozzle extraction. The ring 13 may be of synthetic plastics, synthetic rubber or metal, e.g. spring steel. The body member 5 is provided with a reduced diameter portion 14 between the sealing ring 9 and a second sealing ring 15 located in a second retaining groove 16, with a removable gauze filter sleeve 29 located on the reduced diameter portion 14 and being removable for cleaning purposes by the nozzle 1 being formed in two parts, screwed together and separable at the reduced diameter portion 14. In the embodiments of FIGS. 1 to 11 the nose 6 is frusto-conical, whilst in the embodiments of FIGS. 12 to 14 the nose 6 is cylindrical.

Figure 1:
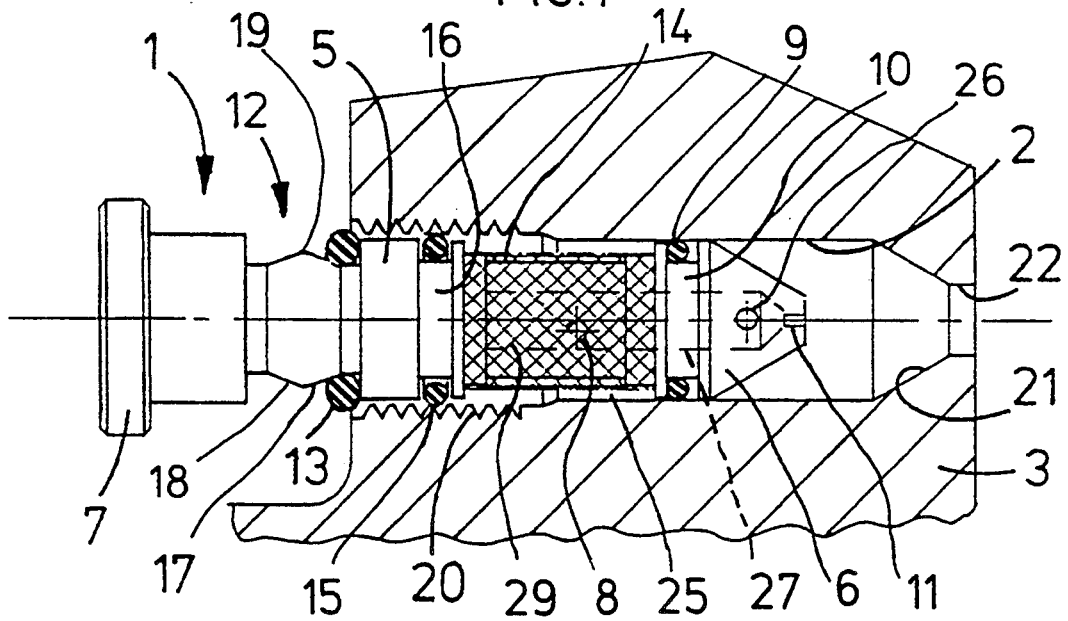
FIGS. 1 to 5 are part sectional side elevations of the sequence of inserting and extracting a first embodiment of nozzle.
Figure 2:
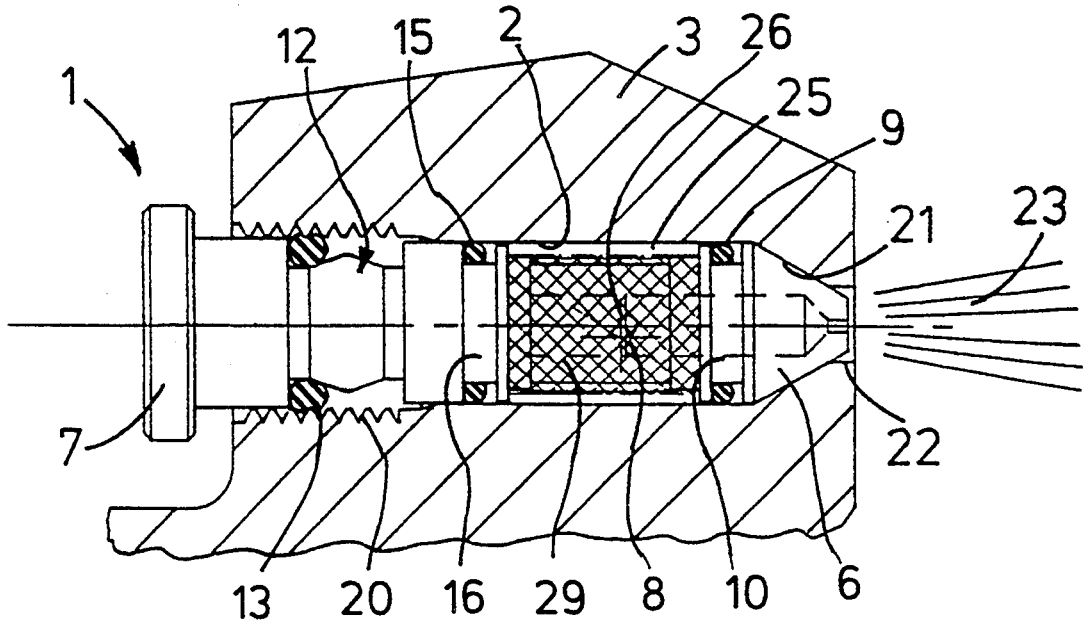
Figure 3:
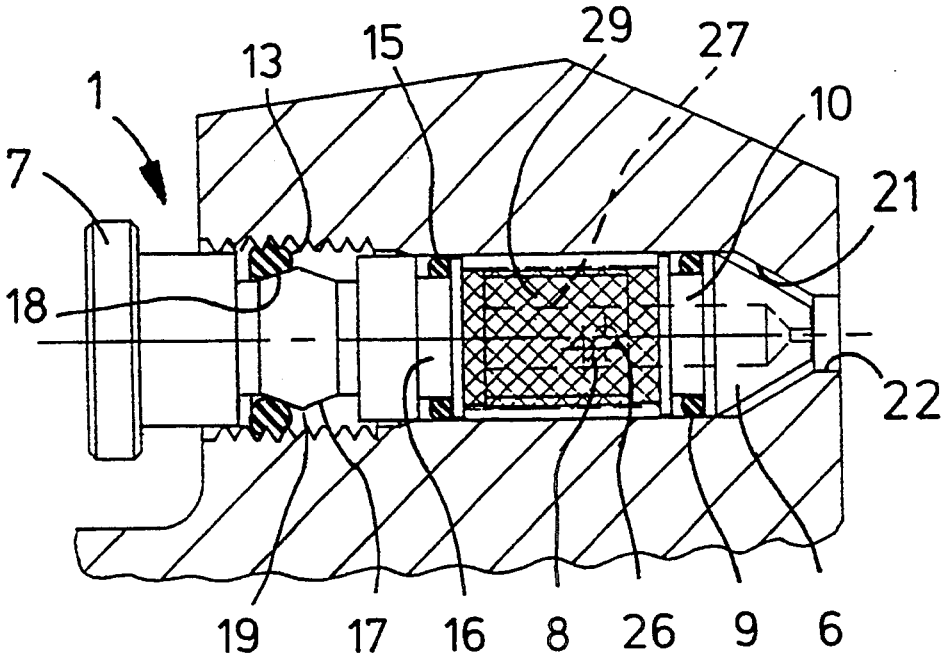
Figure 4:
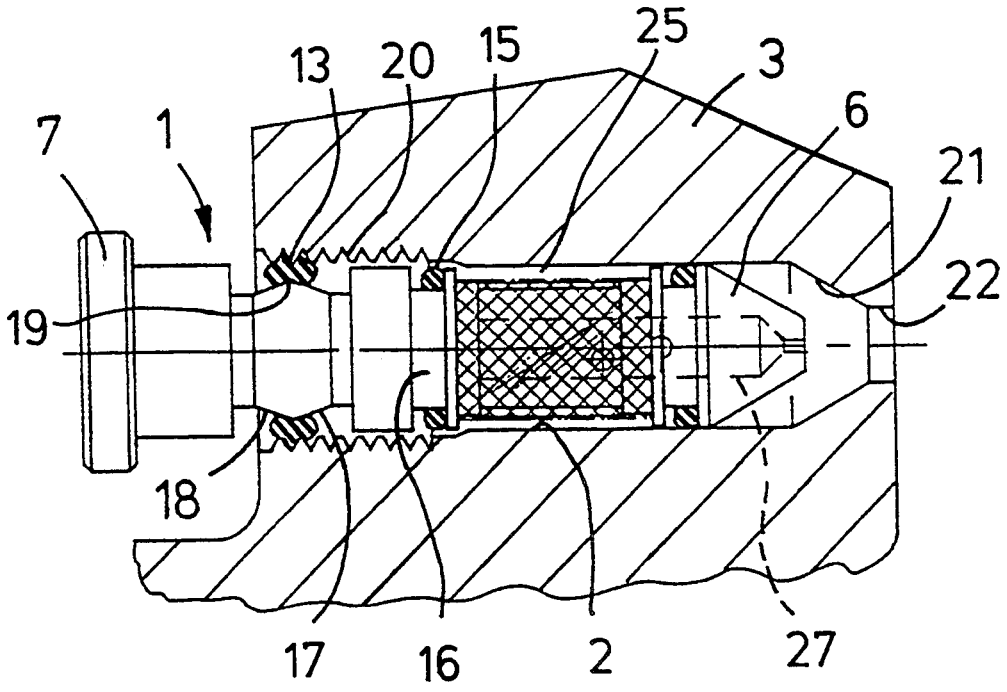
Figure 5:
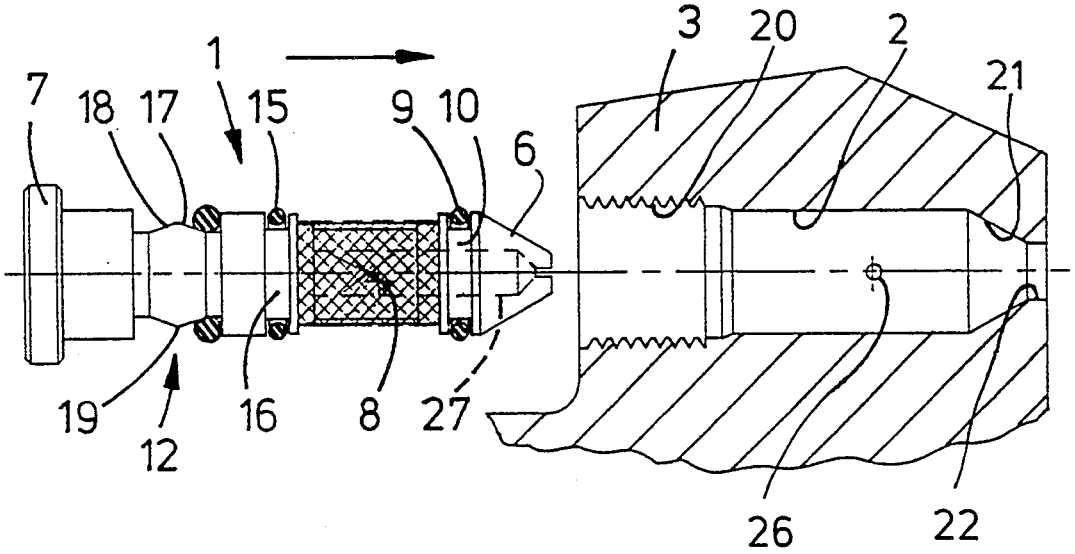

In the embodiments of FIGS. 1 to 5, the ring 13 is a "O"-ring, of circular section—typically of synthetic rubber of synthetic plastics—and the reduced diameter formation 12 comprises a first frusto-conical surface 17 directed towards the nose 6, a second frusto-conical surface 18 directed towards the head 7, and an annular, maximum diameter crown 19 common to, and separating, the two frusto-conical surfaces 17, 18. As indicated in FIG. 1 the nozzle-retaining ring 13 is first located on the frusto-conical surface 17, but when the nozzle 1 has been fully inserted, the ring 13 has rolled up the surface 17, over the crown 19 and onto the surface 18, as illustrated in FIG. 2. It follows that, during extraction of the nozzle 1—the start of which is illustrated in FIG. 3—the ring 13 rolls up the surface 18, onto and over the crown 19 as illustrated in FIG. 4 and then onto the surface 17 as illustrated in FIG. 51.

Also illustrated in all embodiments is the fact that the bore 2 does not have a plain surface over its entire length but on the contrary has an interrupted surface 20 conveniently provided by screwthreads, whereby a portion of the retaining ring 13 is compressible/displaceable/deformable into one or more recesses defined by the screwthreads.

In the embodiments of FIGS. 1 to 11 the bore is provided with a frusto-conical surface 21 onto which the nose 6 seats and an aperture 22 through which the water spray 23 emitted from the water discharge orifice 11 may be directed towards a mineral cutter pick 24 (FIG. 12) releasably retains within the pick box 3.

As illustrated in FIG. 2, when the nozzle I is fitted into its bore 2 and retained by the retaining ring 13 engaging adjacent screwthreads of the interrupted surface 20, no other retaining means is required, as the nozzle 1 is hydraulically balanced between the two sealing rings 9 and 15, while a minimal retaining force is provided by the frictional engagement of the sealing rings 9 and 15 with the plain surface of the bore 2. When inserted, as illustrated in FIG. 2, an annular water receiving chamber 25 is defined between the reduced diameter portion 14 and the bore 2, with water supply to the chamber being via a bore 26 (best seen in FIGS. 1 and 5) and then into interior 27 of the nozzle 1 via the radial bore 8 for eventual discharge via orifice 11.

Figure 6:
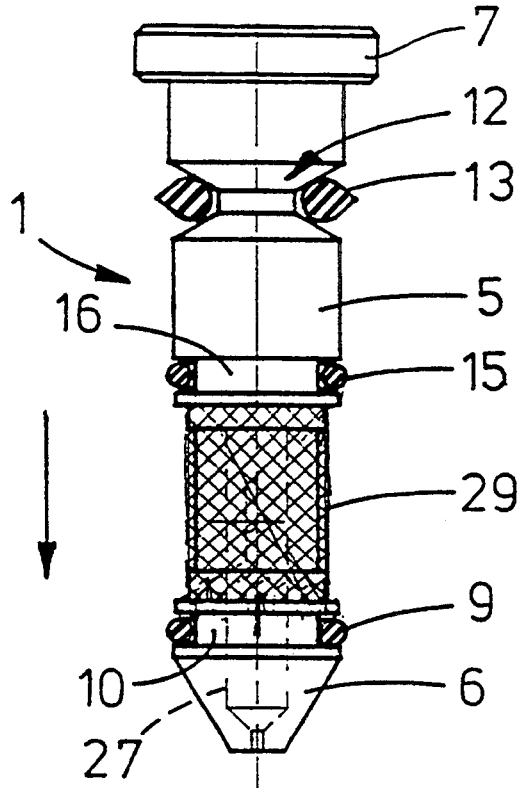
FIGS. 6 and 7 show a second embodiment of nozzle extracted and inserted respectively.
Figure 7:
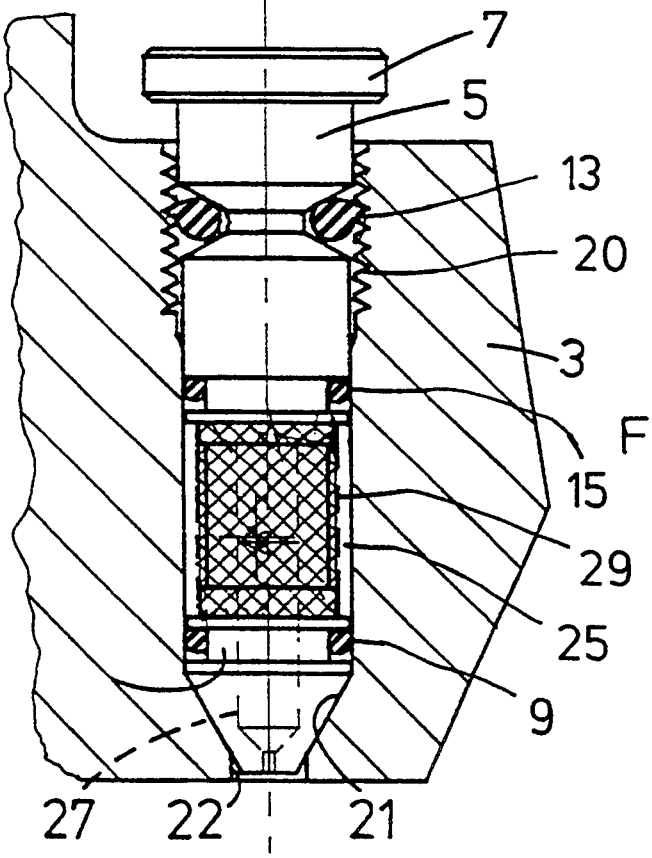
Figure 8:
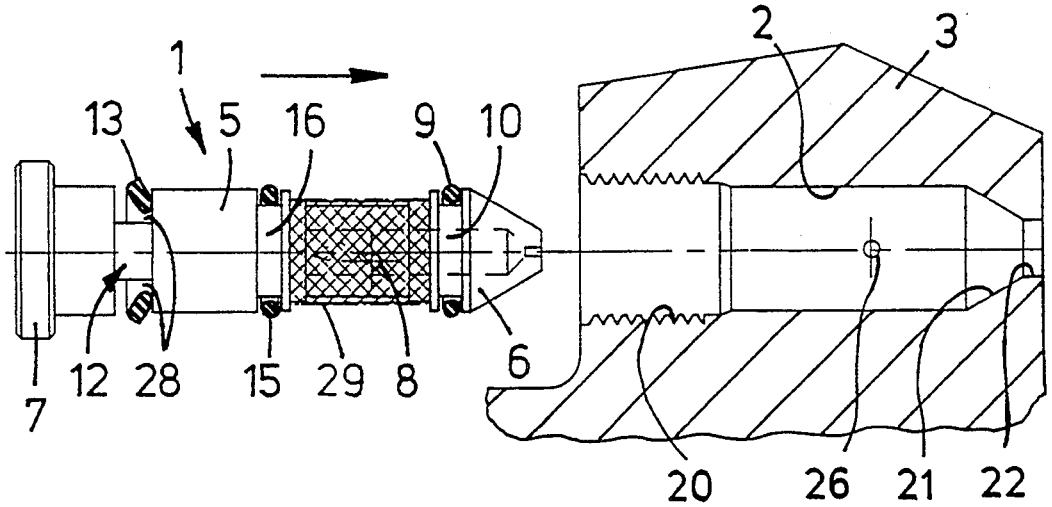
FIGS. 8 to 11 show the sequence of inserting and extracting a third embodiment of nozzle.
Figure 9:
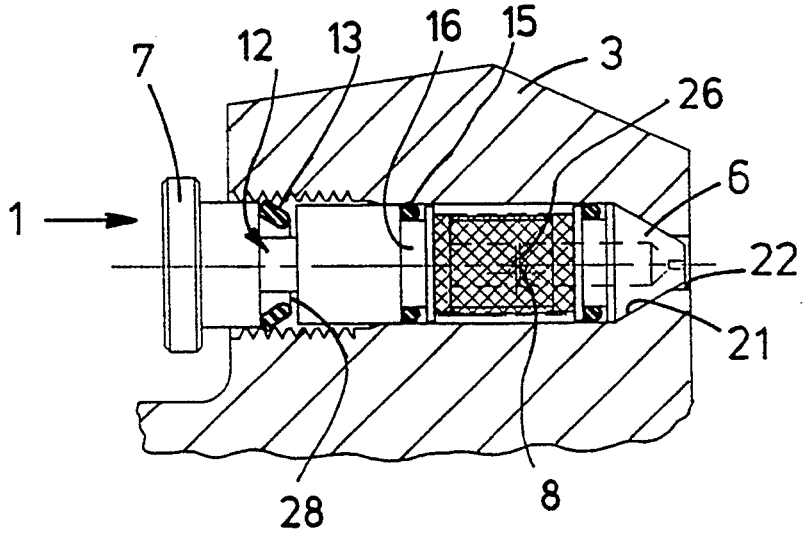

In the embodiment of FIGS. 6 and 7 the retaining ring 13, in contrast to the "O"-ring of FIGS. 1 to 5, has a tear-shaped or pear-shaped section or profile, which is displaceable from the low resistance, insertion position illustrated in FIG. 6 to the high resistance nozzle retention and extraction position illustrated in FIG. 7. Again, the ring 13 of FIGS. 6 and 7 may be of synthetic plastics or of synthetic rubber.

Figure 10:
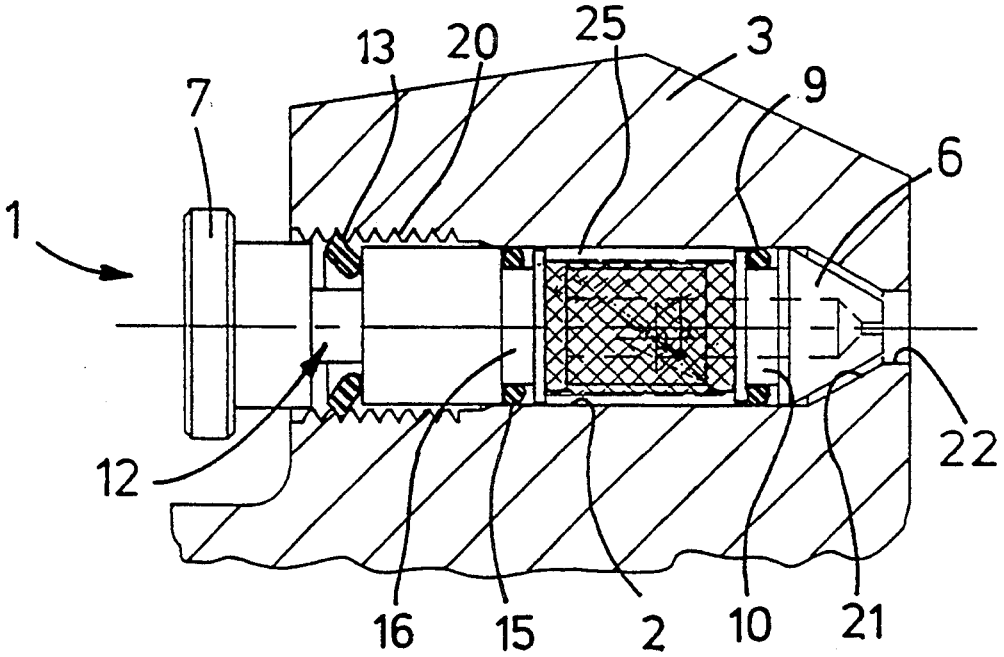
Figure 11:
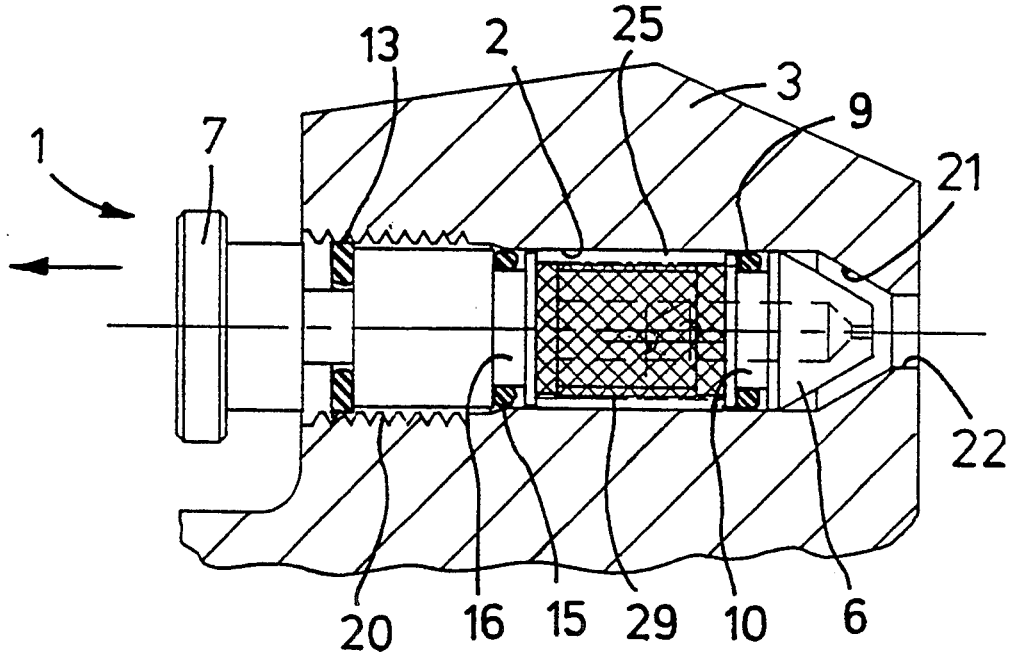

In the embodiment of FIGS. 8 to 11 the retaining ring 13 is constituted by a resilient, metallic disc or grab ring (e.g. a spring steel split ring) located with clearance 28 on the reduced diameter portion 12, with the ring 13 being frusto-conical to provide a lesser resistance to insertion and a greater resistance to extraction. From the non inserted position shown in FIG. 8, the nozzle is fully inserted in FIG. 9 with the retaining ring 13 engaging adjacent threads of the interrupted surface 20. To extract the nozzle 1—the start of which is illustrated in FIG. 10—the ring 13 is partially deformed into the clearance 28, and is fully deformed in FIG. 11 so that extraction can be completed.

Figure 13:
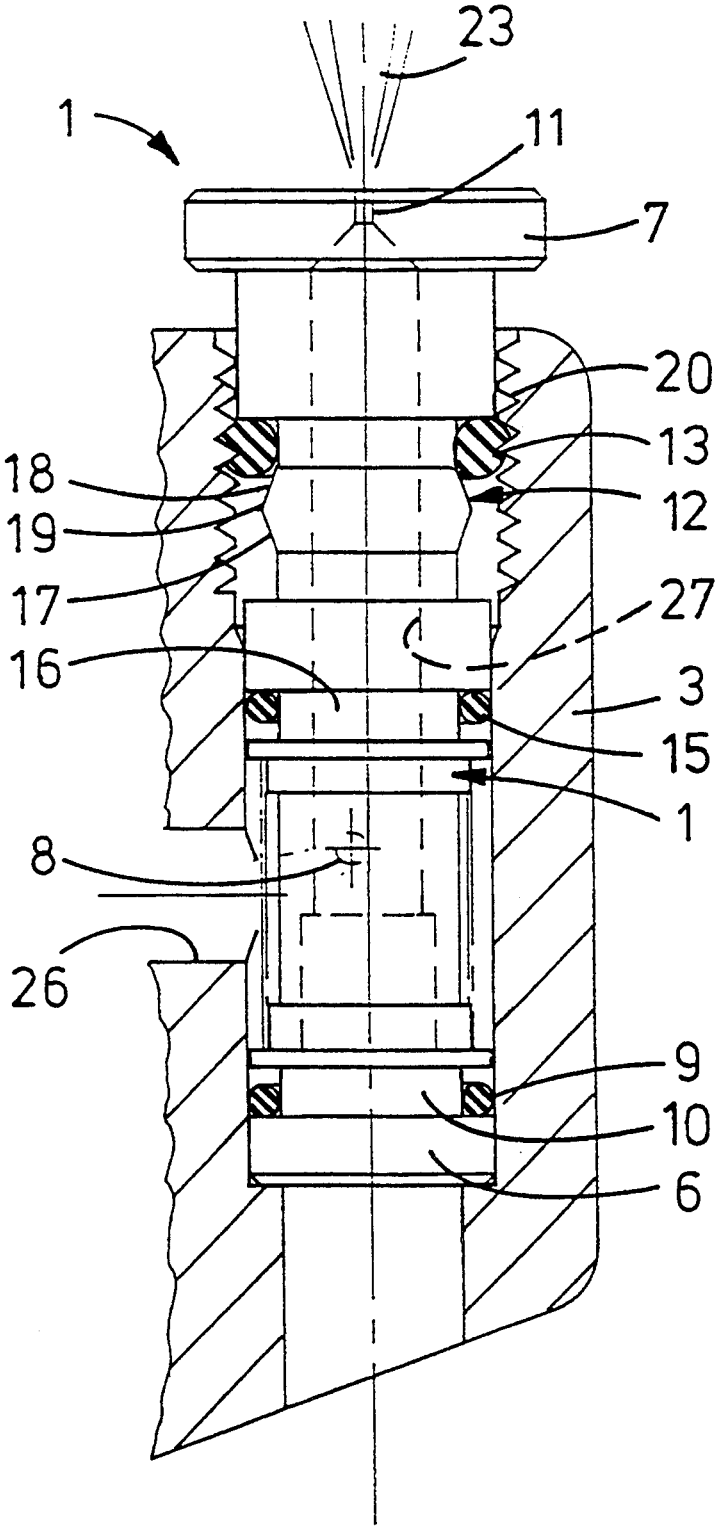
FIG. 13 shows a nozzle of the type of FIGS. 1 to 5 in the location of FIG. 12.
Figure 14:
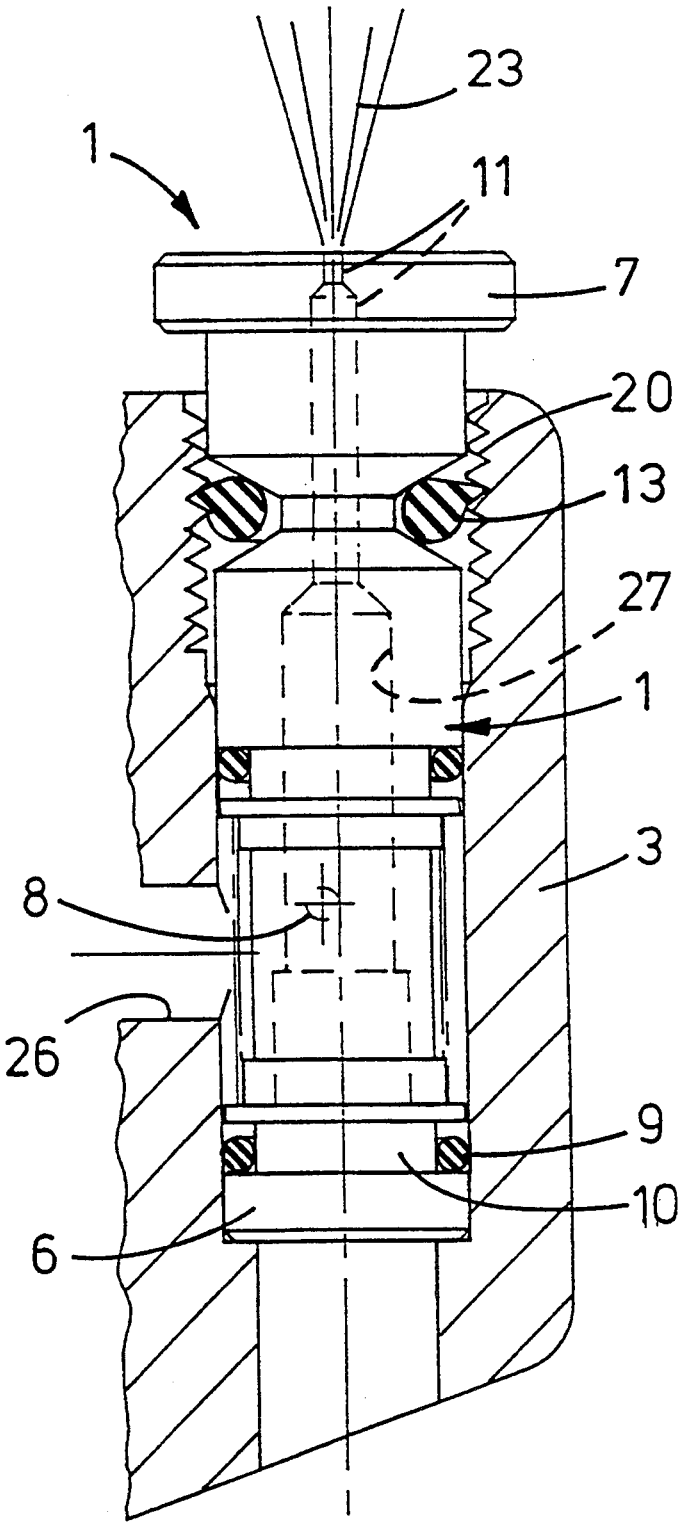
FIG. 14 shows a nozzle of the type of FIGS. 6 and 7 in the location of FIG. 12.

In the embodiments of FIGS. 12 to 14 the construction and location of the pick box 3 is such that the preferred, rear entry of the spray nozzle 1 into its bore 2 (thereby protecting the nozzle 1 from damage or wear, in use, by the mineral being mined) is not possible and consequently front entry is unavoidable, so the water spray 23 is emitted from the enlarged head 7.

FIG. 13 illustrates a nozzle 1 of the kind illustrated in FIGS. 1 to 5 having two frusto-conical surfaces 17, 18 separated by a common crown 19.

FIG. 14 illustrates a nozzle 1 of the kind illustrated in FIGS. 6 and 7 with the retaining ring 13 having a tear or pear-shaped profile.

What I claim is:

1. A water spray nozzle for location in a receiving bore of a pick box of a rotary cutting head of a mining machine, comprising an elongate and generally cylindrical body member, an entry nose located at one end of said body member and an enlarged extraction head located at an opposite end of said body member, said enlarged head, in use, remaining outside said receiving bore; a radial, water inlet orifice intermediate said ends of said body member, a water receiving chamber in communication with said inlet orifice, a retaining groove in said body member between said water inlet orifice and said nose, a water sealing ring located in said groove, a water discharge orifice in communication with said chamber, a reduced diameter formation on said body member, a resilient, nozzle-retaining ring located on said reduced diameter formation, said retaining ring being of material and/or dimensions such that it is compressible and/or deformable, into a nozzle retaining mode, while to extract said nozzle from said receiving bore, sufficient extraction force must be applied to said enlarged head to re-deform and/or re-compress said retaining ring to permit extraction, wherein a secondary retaining groove is provided intermediate said water inlet orifice and said enlarged head, and a second water seal is located in said second groove.

2. A nozzle as claimed in claim 1 which is hydraulically balanced when, in use, subjected to water pressure.

3. A nozzle as claimed in claim 1, wherein said retaining ring additionally functions as a water seal.

4. A nozzle as claimed in claim 1, comprising a reduced diameter portion provided on said body member, and a gauze filter sleeve fitted over said reduced diameter portion.

5. A nozzle as claimed in claim 1 formed by two parts screwed together, so that the two parts are separable by unscrewing for cleaning.

6. A nozzle as claimed in claim 4, wherein said reduced diameter formation comprises a first frusto-conical surface directed towards said nose, a second frusto-conical surface directed towards said enlarged head, and an annular, maximum diameter crown common to, and separating, said two frusto-conical surfaces.

7. A nozzle as claimed in claim 6, wherein said body member is metallic and said frusto-conical surfaces are machined onto said body member.

8. A nozzle as claimed in claim 1, wherein said retaining ring has tear-shaped or pear-shaped profile and is displaceable between a low resistance, nozzle insertion position and a high resistance, nozzle extraction position.

9. A nozzle as claimed in claim 1, wherein said retaining ring is constituted by a resilient disk or grab ring located, with clearance, on said reduced diameter formation of said body member, with said ring displaceable between a low resistance, nozzle insertion position, and a high resistance, nozzle extraction position.

10. A nozzle as claimed in claim 9, wherein said retaining ring is metallic.

11. A pick box having a nozzle receiving bore, in combination with a nozzle as defined in claim 1.

12. A pick box as claimed in claim 11, wherein said receiving bore has an interrupted surface engageable, in said nozzle retaining position, by said nozzle retaining ring.

13. A pick box as claimed in claim 12, wherein said interrupted surface is defined by screwthreads.

14. A rotary cutting head of a mineral mining machine provided with an array of pick boxes as defined in claim 11.

* * * * *